US009013321B2

(12) United States Patent
Kästli et al.

(10) Patent No.: US 9,013,321 B2
(45) Date of Patent: Apr. 21, 2015

(54) SETTING THE OPERATING MODE OF A HAZARD WARNING SYSTEM BY MEANS OF AN ELECTRICALLY READABLE BIPOLE, IN PARTICULAR A RESISTOR, WHICH IS ARRANGED IN A HAZARD WARNING SYSTEM SOCKET

(75) Inventors: Urs Kästli, Männedorf (CH); Matthias Nyikos, Cham (CH); Beat Schmid, Winterthur (CH); Reto Steiner, Uznach (CH)

(73) Assignee: Siemens Aktiengesellschaft, Munich (DE)

( * ) Notice: Subject to any disclaimer, the term of this patent is extended or adjusted under 35 U.S.C. 154(b) by 221 days.

(21) Appl. No.: 13/877,190

(22) PCT Filed: Sep. 27, 2011

(86) PCT No.: PCT/EP2011/066798

§ 371 (c)(1),
(2), (4) Date: May 28, 2013

(87) PCT Pub. No.: WO2012/041868

PCT Pub. Date: Apr. 5, 2012

(65) Prior Publication Data

US 2013/0241738 A1 Sep. 19, 2013

(30) Foreign Application Priority Data

Oct. 1, 2010 (EP) ..... 10185755

(51) Int. Cl.

| | |
|---|---|
| ***G08B 21/00*** | (2006.01) |
| ***G08B 23/00*** | (2006.01) |
| ***G08B 17/00*** | (2006.01) |

(Continued)

(52) U.S. Cl.
CPC ..... *G08B 21/18* (2013.01); *G08B 17/10* (2013.01); *G08B 29/145* (2013.01); *G08B 29/20* (2013.01)

(58) Field of Classification Search
None
See application file for complete search history.

(56) References Cited

U.S. PATENT DOCUMENTS

| | | | | |
|---|---|---|---|---|
| 5,870,022 | A * | 2/1999 | Kuhnly et al. | 340/567 |
| 2013/0021160 | A1* | 1/2013 | Sid | 340/632 |
| 2013/0328687 | A1* | 12/2013 | Nguyen et al. | 340/660 |

FOREIGN PATENT DOCUMENTS

| | | |
|---|---|---|
| CN | 101241019 | 8/2008 |
| EP | 10185755.5 | 10/2010 |

(Continued)

OTHER PUBLICATIONS

International Search Report for PCT/EP2011/066798, mailed Nov. 15, 2011.

(Continued)

*Primary Examiner* — Julie Lieu
(74) *Attorney, Agent, or Firm* — Staas & Halsey LLP

(57) ABSTRACT

A bipole is fitted in a warning system socket for removably receiving a hazard warning system in order to set one of at least two operating modes of the hazard warning system. An electric characteristic of the bipole can be read out electrically by an electronic control of the hazard warning system via two electric contact pairs which are in contact with each other in the received state of the hazard warning system. In particular, the bipole is used via at least one pair of electric contacts, the pair being generally provided for externally connecting an optical and/or acoustic alarm emitter, in order to read in the electric characteristic of the bipole. The bipole is preferably a passive electric resistor.

15 Claims, 1 Drawing Sheet

(51) Int. Cl.

| | |
|---|---|
| ***G08B 21/18*** | (2006.01) |
| ***G08B 17/10*** | (2006.01) |
| ***G08B 29/14*** | (2006.01) |
| ***G08B 29/20*** | (2006.01) |

(56) References Cited

FOREIGN PATENT DOCUMENTS

| | | |
|---|---|---|
| GB | 2325743 | 12/1998 |
| GB | 2447917 | 10/2008 |
| WO | 2005/106822 | 11/2005 |
| WO | PCT/EP2011/066798 | 9/2011 |

OTHER PUBLICATIONS

German Language Chinese Office Action for related Chinese Patent Application No. 201180046970.X, issued Oct. 22, 2014, 16 pages (including partial English translation).

* cited by examiner

SETTING THE OPERATING MODE OF A HAZARD WARNING SYSTEM BY MEANS OF AN ELECTRICALLY READABLE BIPOLE, IN PARTICULAR A RESISTOR, WHICH IS ARRANGED IN A HAZARD WARNING SYSTEM SOCKET

CROSS REFERENCE TO RELATED APPLICATIONS

This application is based on and hereby claims priority to International Application No. PCT/EP2011/066798 filed on Sep. 27, 2011 and European Application No. 10185755.5 filed on Oct. 1, 2010, the contents of which are hereby incorporated by reference.

BACKGROUND

The invention relates to the use of a bipole that is fitted in a hazard warning system socket for removably receiving a hazard warning system, which can be read out electrically by an electronic control of the hazard warning system.

The hazard warning systems considered here are point detectors. They can for example be fire alarms or smoke alarms. Preferably these fire alarms or smoke alarms involve optical fire alarms, which have an optical detector unit operating in accordance with the scattered light principle for the detection of smoke particles. As an alternative or in addition they can have a detector unit operating in accordance with the acousto-optical technique or a gas sensor for the detection of gases typical of fires. Furthermore the hazard warning systems can be acoustic alarm emitters, so-called sounders. They can be flashing lights, so called beacons, or a combination thereof, so-called sounder beacons. Finally the hazard warning system can be an intrusion alarm for the detection of a possible break-in.

Furthermore the hazard warning systems considered here are connected, for transmission of signals or data, via a common alarm line, especially via a two-wire line, to a fire alarm center. A number of such hazard warning systems can be connected in alarm groups or alarm lines to a hazard warning system center, via which the hazard warning systems are also typically supplied with electric power.

The hazard warning systems can have different modes of operation. This means that they can be configured or parameterized in different ways, wherein a mode of operation also encompasses the respective combination of a number of different functionalities which do not have a direct functional relationship with one another.

In the case of a fire alarm for example different levels of sensitivity can be set, such as e.g. via DIP switches or contact bridges. This enables the response time and/or the detection threshold for detection of smoke to be changed for example, depending on whether the fire alarm is to be used for example in an office building or in a welding shop. In the case of an acoustic and/or optical alarm, different values can be set for example for the volume, for the flashing sequence or for alarm tone intervals. In the case of an intrusion alarm different sensitivity thresholds can be set for example. It is also possible for what is known as the anti-masking function to be switched on or switched off.

Instead of setting the parameters by the switches it is also possible for the parameters to be set via a program interface or over the alarm line by the fire alarm center.

The disadvantage of this is that, when the hazard warning system is replaced, new parameters may have to be set for the unit.

SUMMARY

It is thus one possible object to specify an improved method for setting the operating mode and also an improved hazard warning system.

The inventors proposed a hazard warning system which is embodied to be removably received in a hazard warning system socket constructively matched thereto, wherein the hazard warning system, on its side facing towards the hazard warning system socket, has a series of first electric contacts which, in the received state of the hazard warning system in the hazard warning system socket, contact a series of opposing, second contacts. Of these contacts, a first part is provided for connection to an alarm line or alarm cable at least for supply of electric power to the hazard warning system. Furthermore a second part of said contacts is provided to not be connected to the alarm line. Furthermore the hazard warning system has an electronic control for control of the hazard warning system.

The inventors propose that a bipole fitted to a hazard warning system socket of the hazard warning system is used for setting of at least two modes of operation of the hazard warning system, wherein an electric characteristic of the bipole is read out electrically by an electronic control of the hazard warning system via two pairs of electric contacts which contact one another in the received state of the hazard warning system.

The bipole can be a passive component such as an electric resistor, a coil or a capacitor. It can be a diode or a Z-diode. The bipole can also be a combination thereof, such as e.g. a series circuit and/or parallel circuit of said components, wherein this circuit then has two connections for connecting this bipole. The electric characteristic of the bipole is accordingly a resistance value, a capacitance value, an inductance value, a diode on-state voltage or a Zener voltage. It can also be a resonant frequency in a series or parallel circuit of a coil and a capacitor.

This makes it possible in an advantageously simple manner for a desired operating mode to be set by a location-related setting predetermined by the hazard warning system socket. This also means that no parameterization or setting of the desired operating mode is required any longer when the hazard warning system is replaced. Maintenance effort is simplified.

In addition compatibility with existing hazard warning system sockets is also provided. In the event of no valid electric characteristic being able to be read out, i.e. if there is no bipole at all in the hazard warning system socket for example, a default operating mode for the hazard warning system, i.e. a standard operating mode, is set.

In accordance with a variant of the method, a corresponding parameter set and/or a corresponding operating program is loaded from the electronic control for setting the desired operating mode. Typically the operating mode is set by the parameters relevant to the execution of the operating mode, such as e.g. time values, detection threshold values etc. being changed. As an alternative, in the event of a processor-based control being used, such as e.g. a microcontroller, a number of software programs can be loaded into the memory of the microcontroller, which are each intended for execution of one operating mode respectively. The software program to be executed by the microcontroller is selected by a selection program routine, which evaluates the detected electric characteristic in the appropriate manner.

In accordance with a further variant of the method, at least one pair of electric contacts, which is normally provided or is provided in accordance with specifications for external connection of an optical and/or acoustic alarm emitter for increasing the alert level in a detected hazard situation, is used to read out the electric characteristic of the bipole.

In accordance with a further variant of the method, a suitable resistance value for the electric resistance is selected for setting the respective operating mode, which is assigned a comparison value assigned to the respective operating mode, especially within a predeterminable range of resistance values. This means that by suitable selection of a conventional electric resistor, for which there are a plurality of readily available resistance values, an extremely simple setting of the operating mode is possible.

Preferably the bipole is an electric resistor with resistance values ranging from 100 Ω to 100 kΩ, especially in the kΩ range and especially with a rated power loss of less than 1 Watt.

Preferably the hazard warning system is a fire alarm embodied as a point detector, an acoustic alarm emitter, an optical alarm emitter or an intrusion alarm.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
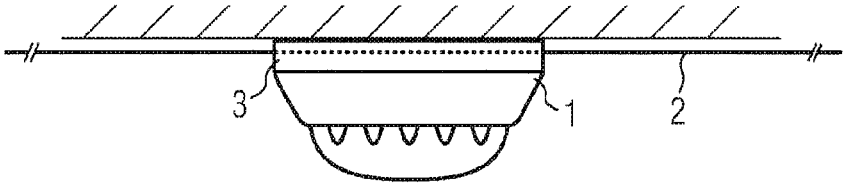
FIG. 1 shows a hazard warning system fitted into a hazard warning system socket, using a fire alarm as an example.

Reference will now be made in detail to the preferred embodiments of the present invention, examples of which are illustrated in the accompanying drawings, wherein like reference numerals refer to like elements throughout.

FIG. 1 shows a hazard warning system 1 fitted in a hazard warning system socket 3 using a fire alarm as an example. The fire alarm 1 can for example be removably received in the hazard warning system socket 3 in the sense of a bayonet connection. It is fitted, for, monitoring a room for example, to a ceiling not further identified. The reference character 2 shows an alarm line, typically a two-wire line, via which the fire alarm 1 is connected for transmission of signals and/or data to a hazard warning system center not shown in any further detail. Electrical power is also mostly supplied to the fire alarm 1 via the alarm line 2.

Figure 2:
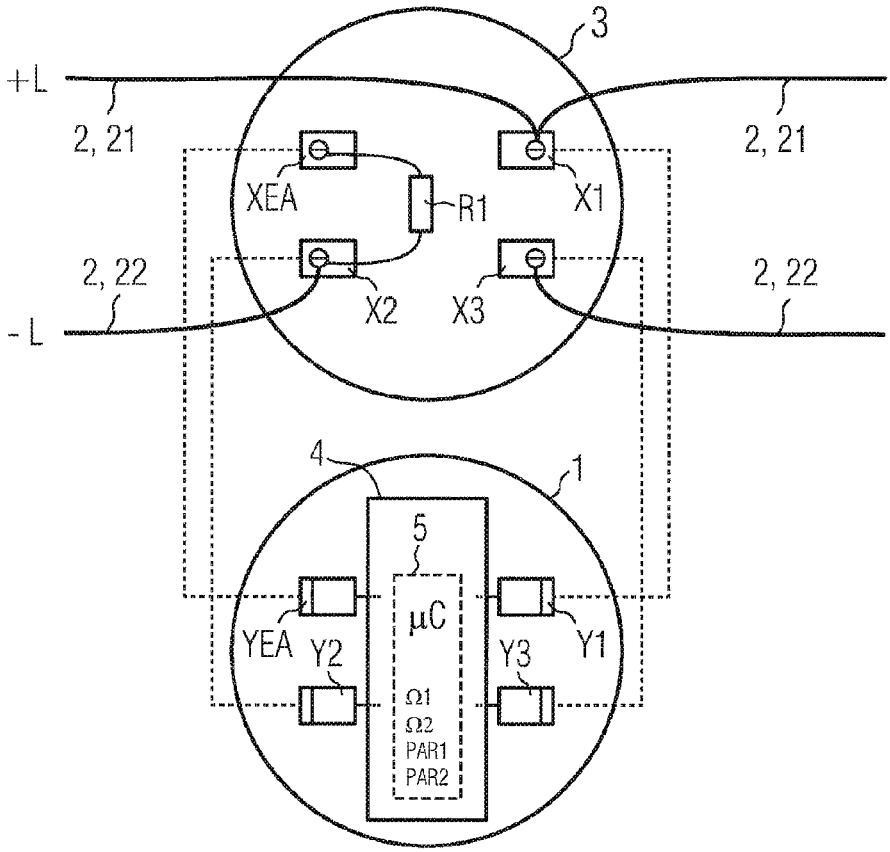
FIG. 2 shows a typical hazard warning system socket with a bipole fitted into it and with four contacts as well as an associated hazard warning system with four mating contacts, for purposes such as reading out the bipole electrically in accordance with the inventors' proposals

FIG. 2 shows a typical hazard warning system socket 3 with a bipole R1 fitted into it and with four contacts X1, X2, X3, XEA, as well as an associated hazard warning system 1 with four mating contacts Y1, Y2, Y3, YEA, the purposes of which is to electrically read out the bipole R1. In the present example the number 21 refers to the PLUS line (+L) and the number 22 to the MINUS line (L−). A DC voltage, which is provided by the hazard warning system center, is typically present on these two lines 21, 22.

The bipole R1 fitted in the hazard warning system socket 3, is used for setting one of at least two operating modes of the hazard warning system 1. In this case, in the received state of the hazard warning system 1, an electric characteristic of the bipole R1 can then be read out electrically via two pairs of electric contacts contacting one another—here the contact pairs X2, Y2; XEA, YEA—by an electronic control 4 of the hazard warning system 1. For this purpose the electronic control 4 can also have a suitable electric or electronic measurement device, such as e.g. window comparators.

In the present example, for setting the desired operating mode, a corresponding set of parameters PAR1, PAR2 is loaded, which is loaded from an operating program stored in the electronic control 4 for executing the set operating mode. As an alternative or in addition, on the basis of the detected and evaluated electric characteristic of the bipole R1, a separate operating program can be started for executing the respective operating mode.

In the example depicted in FIG. 2 the bipole R1 is an electric resistor. It has a resistance value tuned to the desired operating mode, which can be detected with measurement technology by the electronic control. The detected resistance value or another variable representing this resistance value, such as e.g. an electric conductance value or a percentage figure, is then compared with a comparison value Ω1, Ω1 stored in or loadable into the electric control 4. If the detected resistance value of the electric resistor R1 lies within a predeterminable resistance range around the comparison value Ω1, Ω1, one of the operating modes is assigned as valid or is set.

To detect the resistance value of the electric resistor R1, the current flowing through it or the voltage present at it can be detected for example. The resistor R1 can for example have a widely used resistance value, such as e.g. 3.3 kΩ, 4.7 kΩ or 6.8 kΩ. The hazard warning system socket 3 or the two contacts X2, XEA can also remain unconnected to the circuit, such as e.g. for a default operating mode setting. In this case an infinitely high resistance value is detected by the electronic control 4. If this value lies above a predeterminable minimum resistance value, such as e.g. 100 kΩ, then this resistance value can be assigned to the default operating mode.

Preferably the electric characteristic, such as the resistance value here, is read out at least indirectly via an input/output port EA of a microcontroller 5 as part of the electronic control 4. The input/output port EA is preferably configured for analog input/output of an electric analog value. For reading in the resistance value it is configured for reading out, i.e. as an analog input. In particular it is usually provided for external connection of an optical and/or acoustic alarm emitter. One option for the reading out of an electric characteristic is described in FIG. 3 below.

Figure 3:
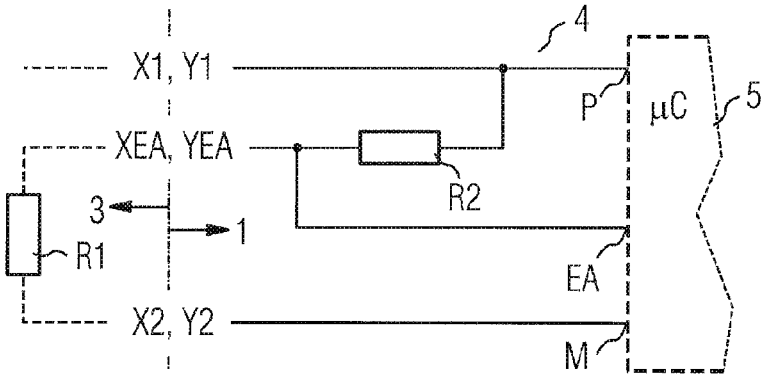
FIG. 3 shows an example for the electrical reading out of the bipole in accordance with FIG. 2 via an input/output port of an electronic control of the hazard warning system.

FIG. 3 shows an example for the electrical reading out of the bipole R1 in accordance with FIG. 2 via an input/output port EA of an electronic control 4 of the hazard warning system 1. The right-hand part of FIG. 3 shows a section of the microcontroller 5. The letters P and M stand for a positive and a negative supply voltage terminal for the microcontroller 5. Further components can also be disposed between these two terminals, such as e.g. protective diodes, voltage regulators etc.

The two are now connected into a circuit for example such that they are linked via the electric contact pairs X1, Y1; XEA, YEA to the PLUS line 21 and the MINUS line 22 of the alarm line 2. In this case the contact pair XEA, YEA has previously only been used for connecting a further external device, such as e.g. an acoustic or an optical alarm emitter. This contact pair XEA, YEA is now used for setting the operating mode. The bipole R1 is connected into the circuit so that, in the received state of the hazard warning system 1 in the hazard warning system socket 3, it is connected via the two pairs of contacts X2, Y2; XEA, YEA in series to a further resistor R2. The voltage drop via the bipole R1 is then detected as an input/output port EA connected as an analog input. From the voltage divider ratio as well as from the known comparison value stored in the microcontroller 5 a computational determination of the resistance value of the bipole R1 is then possible and thus a setting of the desired operating mode by the microcontroller 5 is also possible.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV,* 69 USPQ2d 1865 (Fed. Cir. 2004).

The invention claimed is:

1. A hazard warning system socket to releasably receive a hazard warning system, comprising:

a first pair of electric contacts; and a bipole arranged between the first pair of electric contacts, the bipole having an electric characteristic that can be read out electrically by an electronic control of the hazard warning system via a second pair of electric contacts on the hazard warning system that respectively contact the first pair of electric contacts on the socket when the hazard warning system is received in the socket, so that the electric characteristic of the bipole sets at least one operating mode of the hazard warning system.

2. A method for operating a hazard warning system, comprising:

releasably receiving the hazard warning system in a hazard warning system socket, the socket comprising a first pair of electric contacts and a bipole arranged between the first pair of electric contacts;

using an electronic control device of the hazard warning system to electrically read out an electric characteristic of the bipole via a second pair of electric contacts on the hazard warning system that respectively contact the first pair of electric contacts on the socket when the hazard warning system is received in the socket; and using the electric characteristic of the bipole to set an operating mode of the hazard warning system.

3. The method as claimed in claim 2, wherein for setting the operating mode, a corresponding set of parameters is loaded from the electronic control device and/or a corresponding operating program is loaded from the electronic control device.

4. The method as claimed in claim 2, wherein the second pair of electric contacts includes an operational contact, which is usually provided for external connection of an optical and/or acoustic alarm emitter, and the operational contact is used to read out the electric characteristic of the bipole.

5. The method as claimed in claim 2, further comprising:

setting the operating mode by selecting a suitable resistance value for an electric resistor of the bipole, the suitable resistance value matching one of a plurality of comparison values stored in the hazard warning system, each comparison value being assigned to a respective operating mode option.

6. The method as claimed in claim 2, wherein the hazard warning system is a fire alarm embodied as a point detector, or an intrusion alarm.

7. The method as claimed in claim 2, wherein the hazard warning system is an acoustic alarm emitter or an optical alarm emitter.

8. A hazard warning system to be releasably received in a hazard warning system socket tailored constructively thereto, comprising:

an alarm line to supply electric power to the hazard warning system;

a series of first electric contacts provided on a side of the hazard warning system facing towards the hazard warning system socket when the hazard warning system is received in the hazard warning system socket, such that when received, the series of first electric contacts make respective contact with a series of opposing, second contacts provided on the hazard warning system socket, the series of first electric contacts comprising a first contact intended for connection to the alarm line and a second contact not intended for connection to the alarm line; and an electronic control device via which an electric characteristic of a bipole fitted in the hazard warning system socket is read out electrically, the electronic control device reading out the electric characteristic via at least the second contact not intended for connection to the alarm line, wherein the electronic control device is configured to set an operating mode of the hazard warning system based on the electric characteristic read out from the bipole.

9. The hazard warning system as claimed in claim 8, wherein there are at least two second contacts not intended for connection to the alarm line, and the electronic control device reads out the electric characteristic via the two second contacts not intended for connection to the alarm line.

10. The hazard warning system as claimed in claim 8, wherein the electronic control device reads out the electric characteristic via the second contact not intended for connection to the alarm line and via the first contact intended for connection to the alarm line.

11. The hazard warning system as claimed in claim 8 wherein for setting the operating mode, an appropriate set of parameters is loaded from the electronic control device and/or an appropriate operating program is loaded from the electronic control device.

12. The hazard warning system as claimed in claim 8, wherein the electric characteristic is a resistance value, the electric control unit stores a plurality of resistance comparison variables, and the electronic control sets the operating mode based on a comparison using the resistance value and the resistance comparison variables.

13. The hazard warning system as claimed in claim 8, wherein the electronic control device comprises a microcontroller, and the electric characteristic of the bipole is read out indirectly via an input/output port of the microcontroller.

14. The hazard warning system as claimed in claim 8, wherein the hazard warning system is a fire alarm embodied as a point detector, or an intrusion alarm.

15. The hazard warning system as claimed in claim 8, wherein the hazard warning system is an acoustic alarm emitter or an optical alarm emitter.

* * * * *